United States Patent [19]

Rohde et al.

[11] 4,413,772

[45] Nov. 8, 1983

[54] APPARATUS FOR CENTRIFUGAL SEPARATION

[75] Inventors: Vernon C. Rohde, Newtown; William A. Romanauskas, Southbury, both of Conn.

[73] Assignee: E. I. Du Pont de Nemours and Company, Wilmington, Del.

[21] Appl. No.: 192,081

[22] Filed: Sep. 29, 1980

Related U.S. Application Data

[62] Division of Ser. No. 74,098, Sep. 10, 1979, Pat. No. 4,413,771.

[51] Int. Cl.[3] ..... B04B 5/02; B04B 11/00

[52] U.S. Cl. ..... 494/17; 604/410; 494/20; 494/21; 494/74

[58] Field of Search ..... 233/1 R, 1 D, 1 E, 14 R, 233/26, 17, 32, 47 R; 150/1 R; 229/6, 27, 56; 128/214 R, 214 D, 272

[56] References Cited

U.S. PATENT DOCUMENTS

| | | | |
|---|---|---|---|
| 1,372,893 | 3/1921 | Miller . | |
| 1,725,291 | 8/1929 | Moore | 229/6 R |
| 2,036,987 | 4/1936 | Watson | 229/6 R |
| 2,328,569 | 9/1943 | McGaw | 128/214 |
| 2,542,294 | 2/1951 | Smith | 150/2.1 |
| 3,074,402 | 1/1963 | Broman | 128/214 |
| 3,145,713 | 8/1964 | Latham, Jr. | 128/214 |
| 3,146,172 | 8/1964 | Cullis et al. | 233/26 |
| 3,211,368 | 10/1965 | Shanley | 233/1 |
| 3,561,672 | 2/1971 | Schlutz et al. | 233/17 |
| 3,672,564 | 6/1972 | Schlutz et al. | 233/26 |
| 3,841,838 | 10/1974 | Natelson . | |
| 4,059,108 | 11/1977 | Latham, Jr. | 128/214 |
| 4,127,155 | 11/1978 | Hydorn | 150/1.7 |

FOREIGN PATENT DOCUMENTS

| | | |
|---|---|---|
| 2225532 | 12/1973 | Fed. Rep. of Germany . |
| 2701976 | 1/1977 | Fed. Rep. of Germany . |
| 2058578 | 5/1971 | France . |

*Primary Examiner*—Philip R. Coe
*Assistant Examiner*—Timothy F. Simone

[57] ABSTRACT

A blood bag is described which aids in maintaining the separation of blood components. This bag is constructed of a flexible plastic, has a conical top leading to an outlet line and internal septa to reduce swirling of the bag's contents during rotor deceleration. The bag is adapted to be placed in a split sleeve prior to placement in the swinging bucket of a centrifuge rotor. A collar is placed over the top of the bag to aid in reducing wrinkles in the bag.

Methods are described for reducing contamination of separated blood components by reducing bag wrinkles, reducing swirling of the blood fractions during rotor deceleration, and reducing mixing during expression.

4 Claims, 13 Drawing Figures

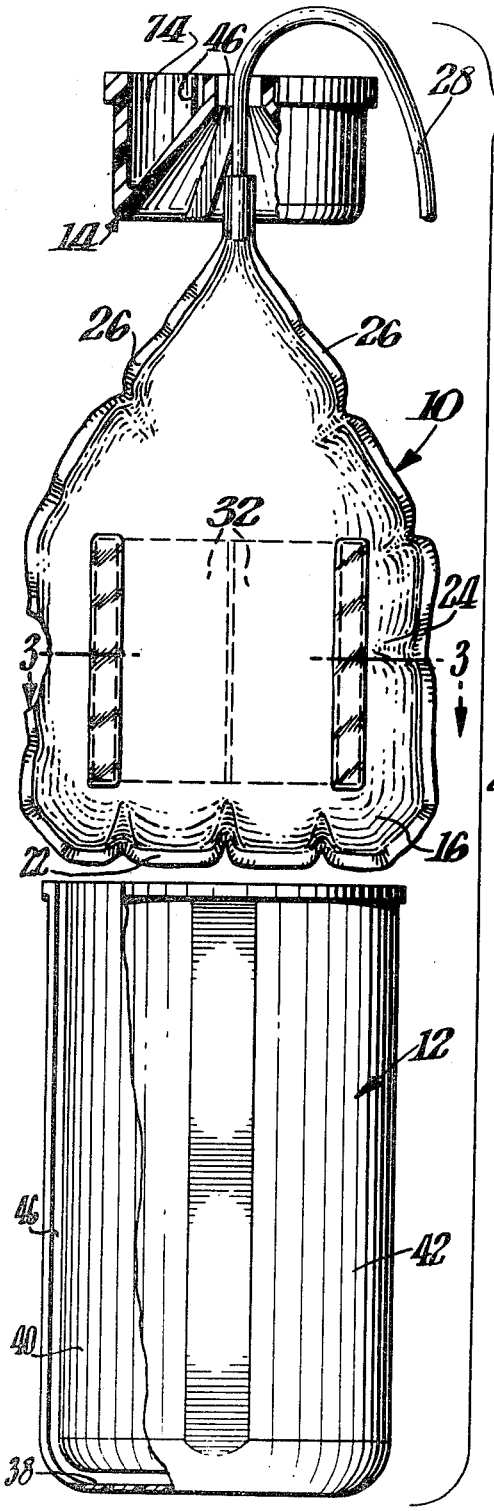
Fig. 1.
Fig. 2.
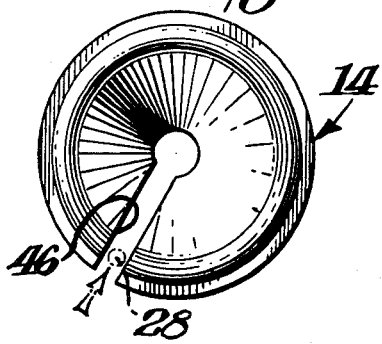
Fig. 3.
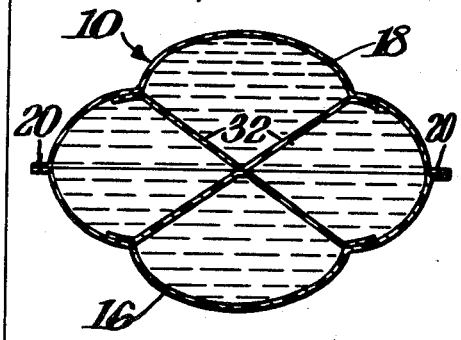
Fig. 4.
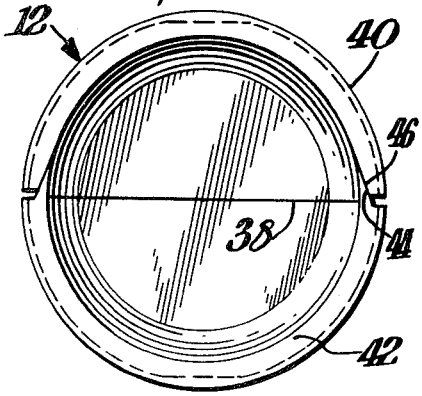

APPARATUS FOR CENTRIFUGAL SEPARATION

This is a division of application Ser. No. 74,098 filed Sept. 10, 1979 now U.S. Pat. No. 4,413,771.

BACKGROUND OF THE INVENTION

This invention relates to a method and apparatus for centrifugally separating particulate material from a liquid phase and, more particularly, to a method and apparatus for the batch separation of blood components.

It is known to use centrifugal techniques for the separation and/or fractionation of particulate materials suspended in a liquid according to particle density, size, shape, etc. Unfortunately, during centrifuge deceleration, and subsequent removal of the separated constituents, there is a tendency for remixing of the separated components. This is particularly true in the case of blood.

The separation of blood into cellular components and plasma, in general, and preparing platelet rich plasma, in particular, has become of great interest to the medical community. The increased use of chemotherapy and other techniques requires platelet concentrate transfusions. Unfortunately, present blood bags and many-batch type blood separation techniques do not facilitate good platelet separation. There is always some incipient remnants or traces of red blood cells and white blood cells. Antigens on certain these blood contaminants give rise to alloimmunization of the recipients of such transfusions, thereby reducing the efficiency of subsequent transfusions. It therefore becomes necessary in many cases to select and type the donors—it being no longer possible to use random donors. This greatly increases the cost. Some of the problems incipiently related to alloimmunization are described in an article entitled, "Correction of Poor Platelet Transfusion Responses with Leukocyte-poor HL-A-matched Platelet Concentrates" by R. H. Herzig, et al., Blood, Vol. 46, No. 5 (Nov.), 1975.

A frequently-used blood component separation procedure involves the preparation, in two centrifugation steps from a single-donor unit of whole blood, of a packed red-cell fraction which also contains most of the white blood cells, a concentrate of platelets suspended in plasma, and a platelet-poor plasma fraction. During the first centrifugation, red blood cells sediment to the bottom of the centrifuge bucket (i.e., pack at the bottom of the blood bag which is oriented horizontally during centrifugation in a swinging-bucket rotor) and a platelet-rich plasma layer extending from the top of the bag to the red-cell interface region is formed. White blood cells are concentrated in the plasma layer immediately above the packed red-cell mass (the so-called buffy-coat region) as well as in the upper portion of the packed red-cell region. After rotor deceleration, the platelet-rich plasma layer is expressed into a satellite bag leaving the packed red cells and buffy-coat layer in the original draw bag. The platelet-rich plasma is then centrifuged to sediment the platelets, after which most of the platelet-poor plasma is expressed into a second satellite bag, leaving a platelet concentrate in the first satellite bag.

One of the factors contributing to contamination (unwanted levels of white and red blood cells in platelet-rich plasma) of the platelet concentrate, giving rise to alloimmunization, is the formation of folds in the upper part of the blood bag during centrifugation. These folds permit the red and white blood cells to become entrapped in the folds hence expressed with the platelet containing plasma causing some of the undesired contamination noted above. This tendency to fold in the top portion of the bag can be aggravated by the fact that satellite packs, tubing and balancing pads are usually placed within the bucket with the blood bag. Further, the technician in removing the bag from the swinging bucket of the centrifuge, as well as in subsequently handling the bag, can cause some disturbance and remixing of the bag's contents.

A second major factor contributing to unwanted contamination of the platelet concentrate is the phenomena which occurs during the final stages of deceleration of the centrifuge rotor. The deceleration of a unit of fluid on the extreme outboard side of the swinging bucket as it reassumes a vertical orientation will be greater than that of a unit on the extreme inboard side. This results in a fluid rotation about the bucket center unit. The rotating or swirling fluid tends to cause some remixing of the components, which were separated during centrifugation, before they can be expressed from the bag into the satellite bags. Efforts in the past to reduce this swirling have been directed to decreasing bucket diameter, using oval buckets, and the like. Long, thin buckets greatly enlarge the size of the centrifuges and hence generally are not a practical solution. Further, the thin, long tubes increase centrifugation time. Swirling can be reduced by increasing centrifugation deceleration time, but this severely reduces throughput and hence greatly increases processing costs.

BRIEF DESCRIPTION OF THE INVENTION

According to one method of this invention, particulate material is separated from, and maintained separated from, a fluid phase, using a storage container having either flexible or rigid walls having top, middle and bottom portions with an outlet line at the top portion, by filling the container with a mixture of the particulate material in the fluid phase, sealing the container, centrifuging the container in a swinging bucket rotor, top portion up, applying a force to a portion of the container to maintain the top portion taut and relatively free of wrinkles which could otherwise trap the particulate material. The force may be applied to the container in many ways. In one instance it may be accomplished by squeezing the container by use of a liquid bladder in the swinging bucket or other similar technique. Alternatively, the force can be applied by a collar, positioned over the top portion of the container and outlet line such that the centrifugal force on the collar forms the top portion of the container tautly about the collar with reduced wrinkles. Preferably the collar is in the shape of an open annulus having a V-shaped cross section. When using a collar with an open annulus, balancing weights may be placed in the annulus to equilize the weights of the loaded buckets placed in opposing positions in the centrifuge rotors. If satellite containers are connected to the main container, they may be stored in the annulus during centrifugation.

In still another alternative technique the force may be applied to the container by positioning a volume-displacing article under the container in the centrifuge bucket during centrifugation such that the container hydroforms about the article and takes up any unfilled space within the container, thereby causing the walls to become taut and relatively wrinkle free.

According to still other alternative techniques, satellite containers may be separated from contact with the main container by placing the main container in a split sleeve and the split sleeve in the bucket with the satellite containers being positioned in an envelope secured in the annular space in between the bucket and the split sleeve.

Various techniques may be used for reducing swirling within the containers during the deceleration of the centrifuge. Among these are the positioning of septa within the container. Alternatively, radially inward protuberances or baffles may be formed on the interior of either the split sleeve, which holds the container, or the bucket in which the container is placed, such that under centrifugal force, the protuberances will, in effect, form inwardly projecting baffles within the interior of the container, thereby reducing the swirling and intermixing of the separated particles.

By forming the top portion of the container into the general configuration of a cone or an approximation thereof, there is reduced turbulence during removal of the separated fractions through an outlet line in the top of the container. Desirably, the cone has an included angle of anywhere from 25° to about 160° with an angle of about 75° being preferred.

One apparatus for effecting reduced intermixing of separated components is a sealed, plastic fluid storage container, generally cylindrical when filled with a fluid, the container having a longitudinal axis and a top and a bottom, and a first tubular conduit communicating with the interior of the container, characterized by an interior septum lying in a plane generally parallel to the longitudinal axis, thereby to reduce the movement of the fluid in the container both during centrifugal deceleration and during handling of the container. Preferably the conduit lies on the longitudinal axis and the top of the container is tapered in a generally conical configuration converging at the first conduit.

According to another aspect of the invention, a sealed, flexible, thermoplastic fluid storage container is constructed having side wall sections with laminate edge seals and a longitudinal axis, two different portions of said edge seals being parallel to said longitudinal axis, and a first tubular conduit means, sealed between said wall sections, communicating with the interior of said container and intersecting said longitudinal axis. This container is provided with edge seals which are tapered from the said different portions to said first conduit means.

Alternatively, or simultaneously, the container is provided with a septum defined by a first sheet of a flexible thermoplastic having ends joined to opposite said side wall sections along laminate seals which are generally parallel to said longitudinal axis. In variations of this container, the taper angle at the top of the container between the edge seals may lie between 25° and 160° thereby to provide a generally conical container top when fluid filled. In other alternative variations, the taper angle may be between 70° and 80° and desirably is about 75°.

The fluid-storage container septum is alternatively defined by first and second sheets of a flexible thermoplastic each having selected ends joined to selected side wall sections and each being joined together along their mid portions, the jointures occurring along laminate seals generally parallel to the longitudinal axis.

In an alternative construction, the upper portion of the side wall sections each may be formed in a double pyramidal shape with additional edge seals such that the top portion of the container more closely approximates a cone when fluid filled. Any additional transfusion ports or inlet tubes should be connected to the bottom of the container such that there are no crevices or recesses provided within the top portion to permit the entrapment of the contaminating red and white blood cells.

BRIEF DESCRIPTION OF THE DRAWINGS

Further advantages and features of this invention will become apparent upon consideration of the following description wherein:

FIG. 1 is an exploded view of a split sleeve, fluid container (blood bag) and collar immediately prior to placement within the split sleeve for later centrifugation;

FIG. 2 is a bottom plan view of the collar illustrated in FIG. 1;

FIG. 3 is a cross-sectional view taken along the section lines 3—3 of the blood bag of FIG. 1;

FIG. 4 is a top plan view of the split sleeve depicted in FIG. 1;

DESCRIPTION OF THE PREFERRED EMBODIMENT

Figure 5:
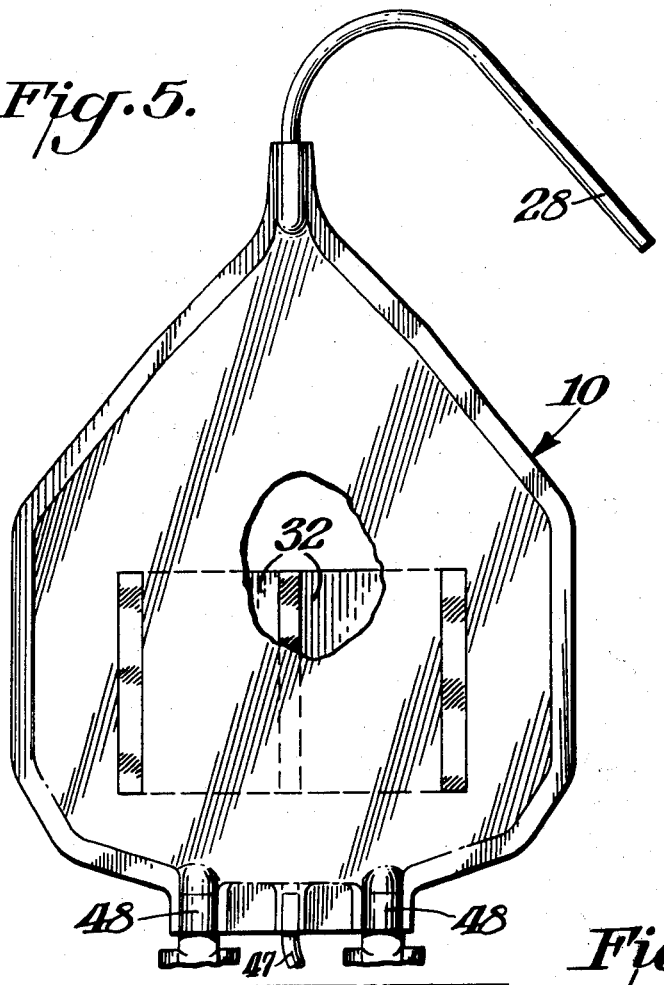
FIG. 5 is an elevation view of a typical unfilled, flexible blood bag constructed in accordance with a preferred embodiment of this invention.

The method of this invention reduces remixing of the separated fractions of particulate material during the deceleration phase of centrifugation and, following centrifugation, during handling of the container and removal by expression of successive fluid and particle containing layers from the container. While the method is applicable, as noted, to the improved separation of any particulate material, or mixture of materials, for the sake of simplicity and clarity, it will be described in conjunction with its use in separation of blood fractions and, in particular, application to the preparation of platelet-rich plasma and maintaining the platelet-rich plasma relatively free of unwanted contamination, i.e., necessarily high levels of, by red and white blood cells.

As is noted, the contamination of separated platelet-rich plasma occurs for several reasons. Among these reasons are that the top portions of flexible containers or bags used to hold the blood during centrifugation tend to fold. This results in the entrapment of blood cells in the folds in the top of the bag. During handling of the bag and/or removal of the platelet-rich plasma following centrifugation, the entrapped blood cells can be released into the previously separated platelet-rich plasma. Another source of contamination of the platelet-rich plasma is the resuspension of the cells from the buffy coat and packed red-cell region during rotor deceleration. The differential force on the blood within the container due to the differences in radial distance between the inner and outer portions of the containers cause a swirling of the bag's contents and resuspension of the cells during the final stages of rotor deceleration.

A further cause of contamination of the platelet-rich plasma by red and white cells is the mixing brought about by the handling of the bag during its removal from the centrifuge bucket or bucket adapter and its placement in a typical wedge-type expressor. Still another cause of blood contamination is cellular resuspension, which occurs during the expressing of the platelet-rich plasma from the bag. This remixing results from the fact that the plasma must travel radially (transverse to the vertical axis) across the bag from the outer portion of the bag toward the center location of the outlet line at a relatively great speed. The fast moving fluid tends to sweep along cells from the buffy coat and packed cell interface region.

According to the method of this invention, the purity of the separated blood fractions may be maintained by reducing folding in the top of the container during centrifugation. One of the causes of folds in the flexible blood container is that varying quantities of blood are drawn into the bags. In fact for a typical bag, containing a fixed amount of anticoagulants, the total amount of blood drawn may vary according to normal specifications by as much as 10% from a normal drawn volume of approximately 450 ml. Accordingly, the blood containers must be designed to accommodate the larger volume; and, if a smaller volume is drawn, the top of the bag is not fluid supported and, under centrifugal force, wrinkles.

This wrinkling of the top of the bag is alleviated according to this invention by several means. These include squeezing the bag during centrifugation to maintain the top portion relatively taut. Such squeezing may be accomplished by the placement of the bag in an annular bladder containing a dense solution in order to reduce the volume of the swinging bucket or adapter in which the bag is held. Alternatively, and preferably, an annular collar, properly slotted to accommodate the outlet line for the bag, may be placed over the top of the bag such that under centrifugal force the plastic bag and its contents will hydroform about the underside of the collar and thereby maintain a relatively smooth condition. To further reduce the areas in which the components may become entrapped, the donor tube or drawline for the bag is placed at the bottom of the bag as are the transfer, addition or transfusion ports. Only the outlet line leading the transfer packs or satellite bags is placed at the top of the bag. Additional ports and/or lines may be placed at the top of the bag if they are prevented from folding over during centrifugation.

In still another alternative, a generally round object may be placed in the bottom of the swinging bucket and the blood bag allowed to hydroform around it, thereby occupying the volume of the bag not displaced by blood and maintaining the top of the bag taut and free of wrinkles. The volume of this object placed in the bottom of the swinging bucket may be varied according to the volume of blood in the bag. A further method of reducing wrinkling in the top of the blood bag is to keep the satellite blood bags out of contact with or in the region of the top of the blood bag. If satellite bags are not allowed to press on the top of the bag, there will be less wrinkling of the blood bag. Satellite bags may be maintained, for example, in the top of the collar if the collar is conformed to have a U-shaped cross section or is otherwise made to be hollow and capable of containing the satellite bag. Alternatively, the satellite bags may be placed in an envelope and positioned about the periphery of the blood bag.

Preferably the blood bag itself is placed in a cylindrical, sleeve-like container or adapter which fits within the swinging bucket of the centrifuge. The satellite bags then may be placed, if desired, between the exterior of the split sleeve and the inside wall of the swinging bucket. To facilitate their handling, the satellite bags may be placed in a thin envelope which can be wrapped about the split sleeve. The split sleeve has a particular advantage in that it reduces handling of the blood bag during removal from the swinging bucket as well as during removal of the bag from the sleeve itself. The two halves of the split sleeve simply may be separated or preferably they may be hinged at the bottom, as will be described hereinafter, so that they may be swung open, thereby permitting the split sleeve to be removed from the bag rather than the bag from the sleeve. This is less disruptive of the contents of the bag than having to pull the latter from a rigid cylindrical container.

Another method of this invention used to reduce swirling of the blood during rotor deceleration is to place septa or baffles within the interior of the bag. This results in a decrease of the force vectors which cause swirling of the blood in that it reduces the differential radii between the smaller compartments produced within the bag by the septa. The septa are located to encompass the region in which the interfaces between packed cells, buffy coat and platelet-rich plasma are formed. Preferably the septa should occupy only the lower portion of the bag and not contact the bottom of the bag so that they allow the lower part of the bag to have some mixing of the packed components and yet they should extend up above where the separation line between the packed cell layer, the buffy coat region, and the platelet-rich plasma so that the contaminating red and white blood cells components cannot swirl and thereby contaminate the platelet-rich plasma. At the same time the septa should not extend up so far as to interfere with the hydroforming top regions of the bag. The septa further act to stabilize the handling of the bag following centrifugation in that they compartmentalize the bag's contents.

During expression it is desirable that the blood bag be placed higher up in the expressor than normal so that the top portion of the plasma is not disturbed unnecessarily by the clamping or squeezing movements of the expressor. Finally, during expression of platelet-rich plasma from the bag, contamination, as noted earlier, occurs through the movement of the cells from the periphery of the bag to the center for removal from the bag. This resuspension is reduced, according to the method of this invention, by positioning the outlet or transfer line of the bag at the top middle and feeding the outlet line with a funnel or approximation thereof. To this end, the top of the bag may be formed in pure conical shape, although this is most desirable from a performance standpoint, it results in a somewhat more expensive construction in most cases. Alternatively, and at a lower cost usually, the conical-shaped funnel may be approximated by forming the top portion of the bag in triangular or pyramidal-like sections which are joined together typically by heat sealing, as will be described, to approximate the funnel.

A blood bag and associated equipment which is particularly adapted to implement the methods of this invention is now described.

DESCRIPTION OF THE PREFERRED EMBODIMENT

There may be seen with particular reference to FIG. 1 an exploded view of one form of flexible container or bag 10 which, in use, is positioned in a clam-shell-like split sleeve 12. As in the case of the method, the apparatus will be described in the environment of blood separation. Hence the bag 10 will be referred to as a blood bag, the fluid phase as blood, and the particulate material as blood cells.

The blood bag 10 is illustrated as a flat-type bag constructed in a generally conventional manner. It has two side wall sections 16 and 18 (FIG. 3) of flexible, chemically inert to blood and nonporous to fluids, thermoplastic sheet or film material. This thermoplastic material may be any of those that are suitable for the manufacture of blood bags. Included among those presently known types of materials are polyvinyl chloride, polyethylene, polypropylene, polyester, and many of the fluorocarbons. The side wall sections 16 and 18 are formed into the flat-type blood bag by edge seals 20 which are applied along the bottom edge 22, side edges 24, and top edges 26.

For simplicity of illustration, a single tubular conduit or line 28, for introducing fluids into the bags or withdrawing fluids from the bag is shown. This line 28 is typically sealed between the edge seams at the top portion of the bag and is termed the outlet line. A fully ported bag having an inlet or draw conduit or line 47 and transfer or other auxilliary ports 48 is depicted in FIG. 5 for completeness of disclosure. This inlet line 28 is normally placed along a generally horizontal or slightly curved or tapered edge.

In accordance with this invention the top edges 26 are tapered to a point at the location where the tubular conduit 28 joins the bag itself. The purpose of this taper is to afford a generally conical funnel shape to the bag, which enhances laminar flow, and reduces transverse shear at the interface of the separated blood fractions, as the expressed fluid approaches the exit or port for the outlet line 28. By forming this conical exit, as the fluid approaches the exit port, its transverse velocity and shear is reduced, in view of the gradual transition produced by the taper itself. Most desirably the included angle of the taper may vary between 25° and 160° (170° being the typical angle used in the bags of the prior art). The 160° maximum angle is important since in this range the transverse shear begins increasing at a relatively high exponential rate. The 25° minimum angle is also important since in this range the tangent function approaches high values and requires bags having an unweildly cone length. In a preferred embodiment of this invention the angle of the taper will vary between 70° and 80° and most desirably will approximate 75°.

With the reduced shear and laminar flow, which occurs as the platelet-rich plasma/white blood cell red blood cell interface approaches the exit port, there is less turbulence created and therefore fewer red and white blood cells are expressed with the platelet enriched plasma fraction through the outlet line 28.

The problem caused by the swirling of the contents of the bag 10 during deceleration of the centrifuge rotor is reduced, in accordance with this invention, by placing septa or partitions 32 in the interior of the bag. Four septa 32 are illustrated in FIG. 1. The septa are formed from strips of the same plastic used for the bag and the ends of these septa 32, in a preferred embodiment of the invention, are heat sealed to opposite interior walls 16 and 18 of the bag itself and joined at their mid portion along an axis of joinder which is generally parallel to the longitudinal or vertical axis of the bag. In this manner, when the line of joinder follows an axis which is also generally parallel to the longitudinal bag axis, vertical compartments are found and, as described earlier, the swirling is reduced. The vertical dimension of this septa is such that the septa does not extend entirely to the bottom of the bag but provides a small space in the bottom to allow mixing of any anticoagulants or additives which are typically used in blood processing. The limiting location for the bottom of the septa is that the septa should extend downwardly to a point where it will rest on the bottom of the adapter after the container has hydroformed to the adapter during centrifugation.

The upward dimension of the septa is such that the septa will extend to a point above the normal interface point between the platelet enriched plasma fraction and the white cells (buffy coat) and underlying packed red blood cell layer which extends to the bottom of the bag. Recall that the height of the packed cell interface will vary somewhat depending on the volume of blood drawn and the red cell content (hematocrit) of the blood. Accordingly, these interfaces must vary in position to some extent based on an average basis and allows some degree of freedom as to the actual quantity of whole blood that can be placed in the bag. In the usual case the blood placed in a bag may be 450±45 ml.

Figure 9:
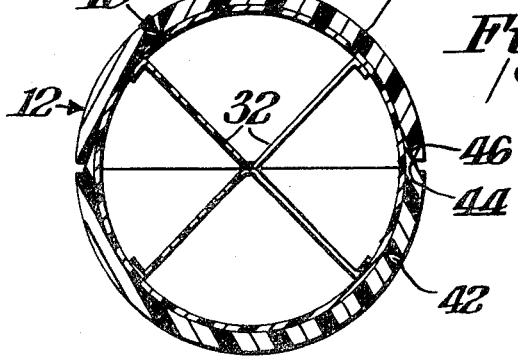
FIG. 9 is a cross-sectional view of the blood bag during centrifugation taken along the section lines 9—9 of FIG. 8.

A further limitation on the upward dimension of the septa is determined by the collar 14, which will be described. The collar preferably should not interfere with the septa during centrifugation, i.e., it must not contact or deform the septa when it moves, during centrifugation, toward the bottom of the bag. The length (horizontal) dimension of the septa is such as to permit the full expansion of the bag in a diametrical sense such that it may expand to the space permitted by the clam-shell like receptacle 12 (to be described). The septa 32 should be relatively taut so as to provide an effective barrier to prevent the swirling described above. The end of the septa are secured to the bag at locations determined by the lengths of the septa—they are secured at locations preferably that will permit the bag to lie flat. This generally results in their having an X-shaped cross section when the bag is full as seen in FIG. 3, i.e., the cavities formed thereby are of approximate equal volume as seen in FIG. 9.

Figure 11:
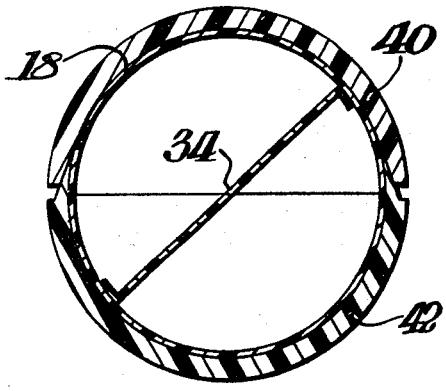
FIG. 11 is a cross-sectional view of a blood bag taken along the section line 9—9 of FIG. 8 constructed in accordance with an alternative embodiment of this invention to provide a single septa.

In an alternative embodiment of the invention depicted in FIG. 11, a single transverse septa 34 may be employed. This is not as desirable as the embodiment depicted in FIG. 3 for the simple reason that the larger cavities or volumes permit greater swirling, an undesirable occurrence which can increase mixing between the separated fractions. Greater swirling is the result of the larger differential radii as explained earlier.

The bag thus constructed is adapted to be placed within a hollow, cylindrical receptacle or split sleeve 12 which is closed at the bottom end 38 by a "living" hinge (the receptacle having been constructed of an appropriate rigid plastic such as nylon, polypropylene or polycarbonate). The receptacle 12 is constructed of two clam-shell halves which join together at their bottom and along a diametrical axis to form the split sleeve. Alternatively, the sleeve could be hinged along one side wall on a longitudinal axis and swing together from the side. The advantage of the sleeve is that the blood bag can be enclosed and removed from the sleeve, or more properly, the sleeve is removed from the bag simply by opening the clam-shell halves of the sleeve rather than attempting to withdraw the receptacle from a cylindrical container, a procedure which tends to be disruptive of the separated fractions within the bag. In the case illustrated, as may be seen particularly in FIG. 4, the two halves 40, 42 of the sleeve are joined along mating longitudinal sections by inclined wedges 44 engaging complementary tapered wall sections 46.

To insure that the top portion of the bag 10 does not wrinkle during centrifugation, a collar 14 is employed. This collar is basically an annulus, which in cross section is generally V-shaped or at least the interior wall of the annulus forms a conical section adapted generally to mate with the taper of the top portion of the bag 10—actually the taper of the bag when flat should be greater than that of the collar since the conical angle decreases as the bag is filled. The collar may be formed of a suitable plastic or any other suitable rigid material and is formed to have a radial slot 46 so as to permit its placement over the outlet line 28. As noted, the bottom portion of a typical bag, as seen in FIG. 5, is the location at which the blood draw line 47 and additional tubular inserts or transfer ports 48 (none are shown in FIG. 1 for clarity) are formed. This permits a smooth surface at the top portion of the bag, free of crevices, which could otherwise cause entrapment of undesired contaminating blood cells.

Figure 6:
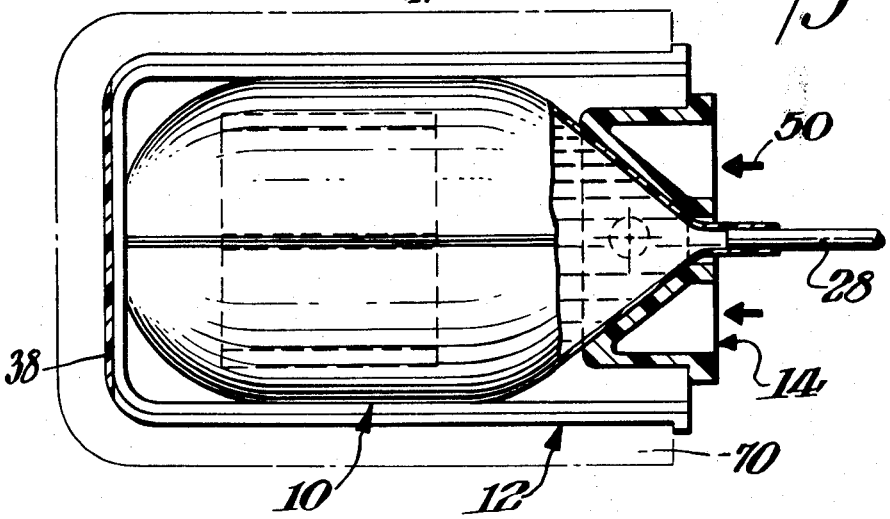
FIG. 6 is a side elevation view partly cut away of the blood bag of this invention (without attached satellite bags or transfusion parts and inlet lines) during the initial phases of centrifugation depicting the operation of the collar at the beginning of centrifuge run.

In using the blood bag, constructed in accordance with this invention, the bag is filled with whole blood through the draw line 47 (FIG. 5). With reference to FIG. 6 (the lines 47 and 48 are not shown) this blood bag 10 is placed within the split sleeve 12 such that it is generally cylindrical with the septa 32 in a taut condition (FIG. 9). The collar 14 is placed over the outlet tubular conduit 28 and the split sleeve placed in the swinging bucket of a centrifuge. The satellite bags and lines are handled as previously described so as to not cause wrinkles in the bag by placing them in the annulus of the collar, etc.

Figure 7:
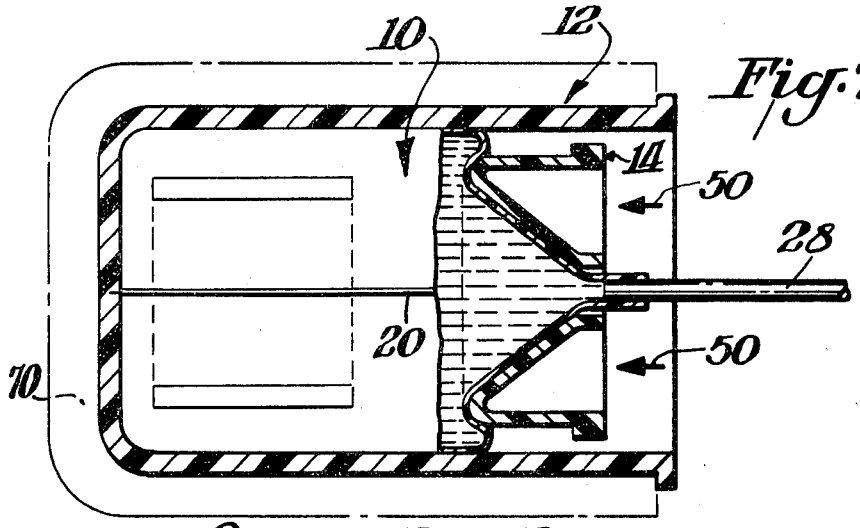
FIG. 7 is an elevation view partly cut away depicting the blood bag of FIG. 6, during centrifugation depicting the smoothing effect of the collar on the top portion of the blood bag.

As is known, as the centrifuge rotor accelerates, the swinging bucket swings outwardly and upwardly to assume the horizontal orientation illustrated in FIG. 6, with the centrifugal force being in the sense indicated by the arrows 50. Under these conditions the collar (assuming the bag is completely filled with blood) tends to move or slide (to the left in the drawing) outwardly from a centrifugal force standpoint so as to engage a portion of the top section of the bag 10, causing the top of the bag to assume a conical shape and drape itself over and about the V-shaped cross section of the collar 14. As may be seen in FIGS. 6, 7 and 8 the outside diameter of the collar 14 is sufficiently less than the inside diameter of the split sleeve 12 to facilitate draping. In this manner, as can be seen particularly with reference to FIG. 7, the top portion of the bag is taut and generally free of wrinkles which would otherwise tend to entrap cells. During deceleration, swirling is prevented by the septa described above.

Figure 8:
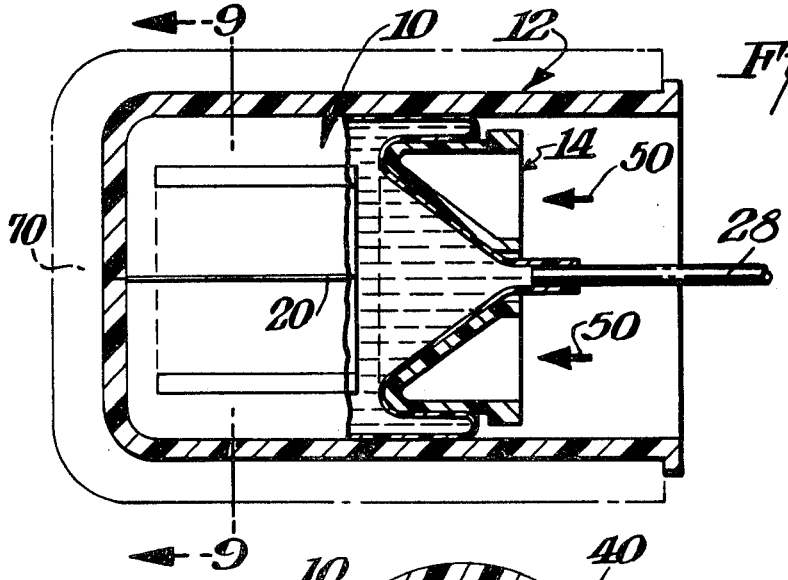
FIG. 8 is an illustration of the same type as in FIG. 7 but depicting the operation of a collar on a partially filled blood bag.

In the event that the bag contains a lesser amount of blood, the collar 14, as depicted in FIG. 8, automatically assumes a greater radial outward displacement, draping a greater portion of the top of the bag 10 over its V-shaped annulus, still maintaining a relatively smooth surface for the entire top portion of the bag such that there are fewer places left for entrapment of cells in the undesired folds. It will be noted in this configuration that the radial displacement of the collar is such as to be just above the topmost portion of the septa and this is, of course, the limiting factor in establishing the height of the septa within the bag, as noted earlier.

Following centrifugation, the split sleeve receptacle 12 is easily removed from the swinging bucket and by virtue of the clam-shell type configuration, spread open, permitting the bag to be removed (or more properly, the split sleeve is removed from the bag) and placed in a typical blood expressor assembly of the type which is commercially available. The plasma enriched fraction at the top portion of the bag may be expressed. This fraction is relatively free of contaminating red and white blood cells due to the features described above in this invention.

Figure 10:
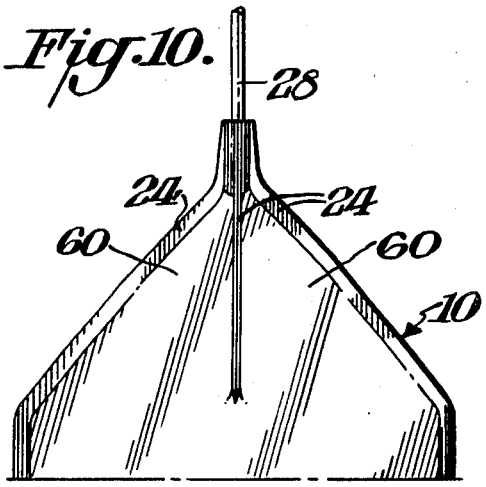
FIG. 10 is a fragmentary illustration of a pyramidal-shaped top portion of a blood bag constructed in accordance with an alternative embodiment of this invention.

In an alternative embodiment of this invention, it is noted, particularly with reference to FIG. 10, that an additional seam 24 is formed at the top portion of the blood bag such that there are now four pyramidal sections instead of two. The four sections are more capable of approximating a conical funnel than two. This is a preferred configuration, although its construction with four seams at the top rather than two may in some cases be slightly more expensive than that of the double seam version depicted in FIG. 1. In this configuration the top portions 60 of the respective side walls of the flat blood bag 10 are double triangles or pyramidal in shape.

While the blood bag described heretofore has been described as a flat bag formed of a thermoplastic material and joined at the side seams, it is to be understood that the bag alternatively may be formed of a flexible plastic using blow molding techniques such that there are no side seams. Alternatively, the bag may be constructed to be of relatively rigid or semirigid material having internal septa. In this eventuality, there is less possibility of entrapment at the top. Hence the utilization of a collar may not be necessary although the internal septa and the funnel-shaped outlet is most certainly used. In this event, the rigid or semirigid material would form the cone shaped top, and no split sleeve is needed.

Figure 12:
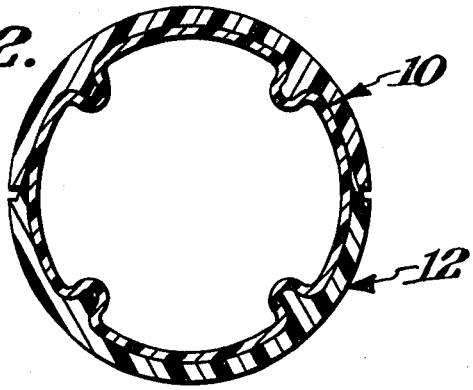
FIG. 12 is a top-plan view of a typical split sleeve constructed to have radially inward projecting fins for forming temporary septa in the bag during centrifugation.

In an alternative embodiment of the invention which may be a substitute for the utilization of internal septa, there is depicted in FIG. 12 a split sleeve having internally directed or radially inwardly directed vertical fins. These fins will cause the bag, when placed within the split sleeve to deform inwardly and form a substitute for the septa in that it would tend (not as effectively as internal septa) to reduce the deceleration effect or swirling during deceleration. The vertical fins are depicted as having only a small radial dimension and as only four in number. The radial dimension may be increased to further reduce swirling, but the number of fins should remain small. Alternatively and preferably, fins having alternating greater and lesser radial dimensions may be used.

Figure 13:
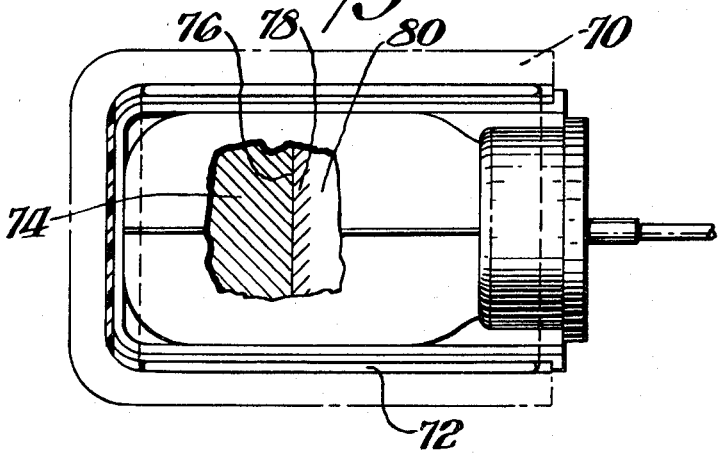
FIG. 13 is an elevation view of a centrifuged, filled blood bag depicting the separated blood components.

A further alternative embodiment of the invention is depicted in FIG. 13 which is an alternative structure of the invention in which satellite bags such as those connected to the satellite line of FIG. 5 may be placed in an envelope which is wrapped around in an annulus which may be provided for between the exterior or periphery of the split sleeve 42 and a centrifuge bucket 70. The envelope 72 need not be used, but it does greatly facilitate the placement of the satellite bags and lines in the small annulus between the split sleeve and the swinging bucket. Alternatively, the satellite bags may, if desired, be placed within the annular space 74 (FIG. 1) of the collar 14. In still another alternative embodiment, this annular space 74 may be used for the placement of balancing weights for the swinging bucket centrifuge as previously described. In this figure the bag is partially cut away to show the platelet-rich plasma 80, the buffy coat 78, packed red cells 74 and the interface 76 therebetween.

There has thus been described a relatively simple method of and blood bag for centrifuging blood bags, which method and apparatus greatly facilitates the preparation of platelet concentrates relatively free of unwanted blood cell contamination. Although described in connection with blood separations, it is to be understood that the method and apparatus are equally useful for a wide range of particulate separations. Further, the bags or containers may be formed using any of the forming techniques known in the plastics and like industries and include injection moldings, centrifugal casting and the like.

We claim:

1. Apparatus for separating particulate material from a fluid phase comprising:

a sealed, flexible plastic fluid storage container having a longitudinal axis and a first tubular conduit means sealed to said container, communicating with the interior of said container and intersecting said longitudinal axis, the portion of said container contiguous the conduit being generally conical, a hollow cylindrical centrifuging receptacle, adapted for use in a swinging bucket type centrifuge, having a longitudinal axis, being closed at one end, and adapted to receive said container, with the receptacle and container axes coincident, an adapter configured to fit over said conduit means and slide within said receptacle to engage the said container, said adapter being in the shape of an annulus having a V-shaped cross-section and an outside diameter sufficiently less than the inside diameter of the receptacle to allow the container to drape over the V-shaped cross-section, and an inner surface which is conical in shape such that, when the adapter and receptacle are under axial centrifugal force, the adapter maintains the conical portion of said container continguous the conduit under tension and free of wrinkles by virtue of its being draped over the V-shaped cross-section of the adapter.

2. Apparatus as setforth in claim 1 wherein said container includes a septum defined by a first sheet of a flexible plastic positioned within the container and having ends joined to opposite interior portions of the container along seal lines which are generally parallel to the longitudinal axis, the septum extending less than the height of said container measured along said longitudinal axis.

3. Apparatus as setforth in claim 1 or 2 wherein the receptacle is a unitary piece defined by two hollow half cylinders each closed and hinged at one end by a living hinge.

4. Apparatus as setforth in claim 1 or 2 wherein the annulus of said adapter is hollow defining an annulus trough in which the conduit means can be deposited for centrifugation without causing wrinkles or distortions in the storage container during centrifugation.

* * * * *